United States Patent [19]

Pietschmann

[11] 4,354,071

[45] Oct. 12, 1982

[54] PLURAL PEDAL FOOT CONTROL

[75] Inventor: Helmut Pietschmann, Karlsbad, Fed. Rep. of Germany

[73] Assignee: Sybron Corporation, Rochester, N.Y.

[21] Appl. No.: 150,057

[22] Filed: May 15, 1980

[51] Int. Cl.[3] ..... H01H 21/26

[52] U.S. Cl. ..... 200/86.5; 338/32 H; 338/200; 74/478

[58] Field of Search ..... 307/113; 338/153, 200, 338/108, 32 H; 116/DIG. 28; 200/5 R, 5 A, 5 B, 18, 159 R, 86.5, 153 C; 74/478, 512, 513, 514, 560

[56] References Cited

U.S. PATENT DOCUMENTS

| | | | |
|---|---|---|---|
| 3,472,974 | 10/1969 | McGough | 200/159 R |
| 3,821,529 | 6/1974 | Kallage, Jr. | 200/159 R |
| 4,000,389 | 12/1976 | Misson | 200/159 R |
| 4,046,049 | 9/1977 | Luce | 338/153 |
| 4,164,637 | 8/1979 | Miyazi | 200/86.5 |

*Primary Examiner*—Gerald P. Tolin

*Attorney, Agent, or Firm*—Theodore B. Roessel; Roger Aceto; J. Stephen Yeo

[57] ABSTRACT

In a foot control, two or more pivoted pedals have a common main spring which provides the same resistance to all pedals. A bias arrangement keeps one pedal from falling down if the other pedal is depressed. A bias arrangement may be a horizontal rod associated with each pedal. The rod is spring biased against the pedal at a location below the pivot axis.

In a two pedal embodiment both pedals can control a single electrical element. A stud extends from each horizontal rod. The stud normally prevents a spring biased pivoted member from pivoting and actuating the electrical element. When a pedal is depressed, the corresponding rod and stud move to allow the pivoted member to actuate the electric element and a corresponding switch.

4 Claims, 2 Drawing Figures

PLURAL PEDAL FOOT CONTROL

BACKGROUND OF THE INVENTION

This invention pertains to electrical control devices more particularly concerned with the mechanical arrangement of foot controls.

A traditional control device is the foot control because it leaves both the users hands free. A foot control has one or more pivoted pedals which upon depression causes a continuous change in an electrical parameter, such as electrical resistance or output voltage.

In some applications two pedals are required as two functions are to be controlled. Each pedal may be depressed individually or in some situations both are to be depressed simultaneously.

The tactile feel of the pedals is of great importance to the experienced operator. It is the primary object of this invention to provide a foot control which offers substantially identical resistance to the user where the pedals are depressed individually or simultaneously.

SUMMARY OF THE INVENTION

In a foot control, two or more pivoted pedals have a common main spring which provides the same resistance to all pedals. A bias arrangement keeps one pedal from falling down if the other pedal is depressed. A bias arrangement may be a horizontal rod associated with each pedal. The rod is spring biased against the pedal at a location below the pivot axis.

In a two pedal embodiment both pedals can control a single electrical element. A stud extends from each horizontal rod. The stud normally prevents a spring biased pivoted member from pivoting and actuating the electrical element. When a pedal is depressed, the corresponding rod and stud move to allow the pivoted member to actuate the electric element and a corresponding switch.

DESCRIPTION OF THE PREFERRED EMBODIMENT

Figure 1:
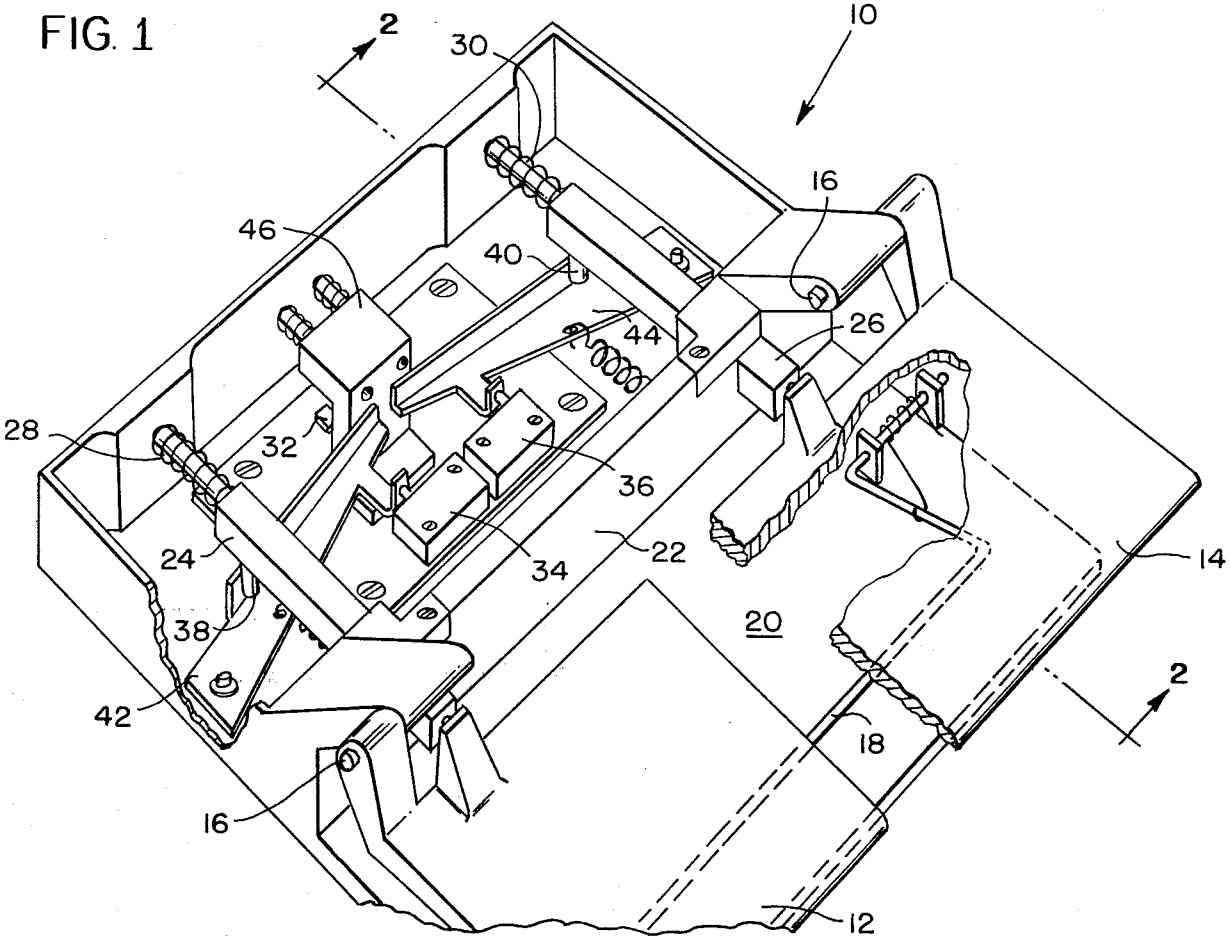
Fig. 1 is a perspective view showing components of a two pedal foot control which embodies the invention.
Figure 2:
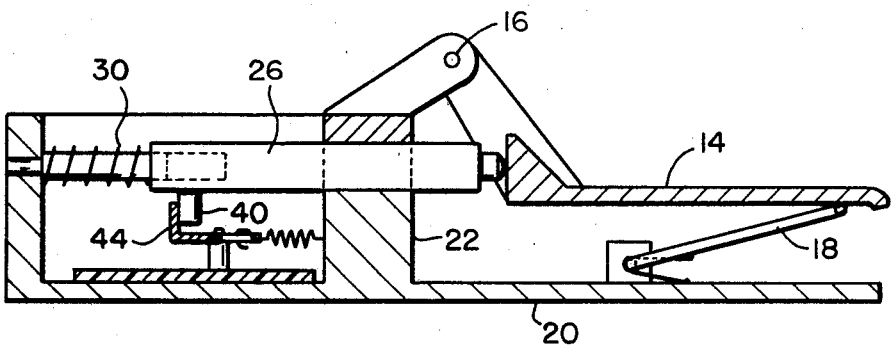
FIG. 2 is a vertical sectional view taken along lines 2—2 of FIG. 1, various elements not claimed being omitted for clarity.

The single drawing shows a foot control 10 having two pedals 12, 14 pivoted upon a pivotal axis 16. Arranged underneath both is a U-shaped wire 18 which has its ends pivoted to the base 20 of foot controller 10. Wire 18 extends beneath the pedals and is biased upwards against the pedals 12, 14. The U-shaped wire 18 is called the main spring.

The base 20 of pedal 10 has a vertical wall 22. Each pedal is pivoted at one end adjacent the top of wall 22 at a pivotal axis 16. Extendinging slidably through the wall are horizontal rodes 24, 26, one corresponding to each pedal. Each pedal 12, 14 is in contact with its rod 24, 26 at a location below the pivotal axis 16. The rods 24, 26 are biased towards the pedals by helper springs 28, 30 and tend to pivot the pedals 12, 14 upwardly about pivotal axis 16 independent of the main spring 18. The resistance of the main spring 18 is substantially greater than that of the helper springs. With this arrangement, the main spring 18 gives the same resistance whichever pedal is depressed or if both pedals are depressed so that the tactile feel of the pedals to the user is substantially the same in either case.

If only one pedal is depressed, the other pedal will lose the support of the main spring 18 but will be held up by its corresponding helper spring comprising springs 28, 30 and rods 24, 26.

Thus, for filling one object of the invention there has been provided a foot control which offers substantially identical resistance to the user when the pedals are depressed individually or simultaneously.

The use of three or more pedals is considered to come under the claimed invention. As another feature in a two pedal foot control, both pedals may cause the actuation of a single electrical element. The preferred electrical element is a linear Hall effect sensor. This feature forms no part of the present invention but is presented merely to illustate a practical application for a foot control having the plural pedal and spring arrangement as claimed. The practical application as briefly described herein has been made the subject of a co-pending application, Ser. No. 240,598, filed Mar. 4, 1981, entitled "Foot Controller For Dental Instruments Or The Like."

The Hall effect sensor is well-known in the art and includes a bar of semi-conductive material. When DC is voltage applied across the semi-conductor in the presence of a magnetic field, an output voltage appears upon the bar perpendicular to both the applied voltage and the magnetic lines. The output voltage is linearly proportional to the distance of the magnet from the semiconductor. These sensors are temperature sensitive and it is difficult to have two stay calibrated and track each other hence it is both advantageous and more economical to use only one Hall device. The output voltage is used to control separate functions. The particular function controlled is determined by the position of function switches in the control.

Either of the pedals 12, 14 may effect the output voltage of a single Hall effect linear control device 32 and switch a corresponding function switch 34, 36. Corresponding members 42, 44 which are pivoted to base 20 are spring biased toward the function switches 34, 36. Extending from each rod 24, 26 is a stud 38, 40 arranged to engage a corresponding pivoted member 42, 44. The free end of each pivoted member 42, 44 is in contact with a spring biased slide 46 which carries the magnets for affecting the voltage output from the Hall effect device.

In operation, depressing a pedal 14 allows its corresponding rod 26 to slide against the bias of its helper spring 30. The stud 40 on rod 26 pushes the associated pivoted member 44 towards slide 46 and away from function switch 36. This allows the pivoted member 44 to actuate its corresponding function switch 36. Simultaneously, pushing the magnetic slides 46 and moving it in relation to the Hall element 32 changes the output voltage of the element. This change in output voltage is applied to means (not shown) to control the quantity of the function selected by switch 36. The output voltage may vary from 0.5 volt to 5 volts depending upon the amount either pedal is depressed. The positions of the function switches 34, 36 are informative of which pedals are depressed. Thus, each pedal can control separated functions by the single Hall device 32 common to both pedals.

I claim:

1. In a foot controller having plural pedals for actuating and controlling selected functions responsive to a user stepping on and depressing one or more of the pedals, the improvement comprising a system to provide each of said pedals with substantially the same tactile feel to the user whether the pedals are depressed singly or in combination comprising:

(a) a base (20) including means defining a generally horizontally oriented pivotal axis (16) spaced above said base;

(b) at least two, side-by-side foot pedals (12, 14) mounted to said base for movement about said pivotal axis;

(c) plural helper spring means (24, 26, 28, 30), one associated with each foot pedal for independently urging its associated pedal upwardly to a first position;

(d) a main spring (18) between said base (20) and pedals (12, 14) for urging said pedals upwardly about said pivotal axis (16) to said first position, said main spring being common to all of said pedals and being substantially stronger than said helper spring means so that depressing, singly, any one of said pedals against said main spring removes the bias of said main spring from each pedal not depressed; and (e) each pedal not depressed being maintained at said first position by its associated helper spring means.

2. A foot controller as in claim 1 wherein said main spring is a U-shaped wire which extends across said base and beneath all of said pedals, the ends of the U-shaped wire being pivotally connected to said base so as to bias said wire upwardly against said pedals.

3. The foot controller as in claim 1, wherein said base includes a vertical wall, said pedals each being pivoted at one end to said wall adjacent the top thereof, said plural helper spring means each being generally horizontally oriented and engaging its associated pedal at a point below the pivotal axis of said pedals for urging the same to said first position.

4. A foot controller as in claim 3 wherein said plural helper spring means each includes a spring biased rod extending slidably through said wall, one end of said rod engaging its associated pedal.

* * * * *